US007243481B2

(12) United States Patent
Draghetti

(10) Patent No.: US 7,243,481 B2
(45) Date of Patent: Jul. 17, 2007

(54) METHOD AND MACHINE FOR PACKING A PRODUCT IN A FLAT TUBULAR PACKAGE

(75) Inventor: Fiorenzo Draghetti, Medicina (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 10/523,635

(22) PCT Filed: Jul. 31, 2003

(86) PCT No.: PCT/EP03/50353

§ 371 (c)(1),
(2), (4) Date: Oct. 14, 2005

(87) PCT Pub. No.: WO2004/014730

PCT Pub. Date: Feb. 19, 2004

(65) Prior Publication Data

US 2006/0117714 A1 Jun. 8, 2006

(30) Foreign Application Priority Data

Aug. 5, 2002 (IT) ..... BO2002A0521

(51) Int. Cl.
*B65B 3/02* (2006.01)
*B31B 1/80* (2006.01)

(52) U.S. Cl. ..... 53/458; 53/564; 493/313

(58) Field of Classification Search ..... 53/457, 53/458, 468, 564; 493/313, 314, 315, 316, 493/317; 271/12, 99, 107; 414/797.8, 798.9, 414/797, 798

See application file for complete search history.

(56) References Cited

U.S. PATENT DOCUMENTS 2,966,100 A * 12/1960 Engleson et al. ..... 493/317
4,629,446 A * 12/1986 Focke ..... 493/317
4,685,272 A * 8/1987 Kawai et al. ..... 493/317
5,061,231 A * 10/1991 Dietrich et al. ..... 493/317
5,067,937 A * 11/1991 Aschaber et al. ..... 493/315
5,078,669 A * 1/1992 Dietrich et al. ..... 493/315
5,105,600 A 4/1992 DePoint, Jr. et al.

(Continued)

FOREIGN PATENT DOCUMENTS

DE 202 14 693 A 1/2003
EP 0 673 834 A 9/1995

(Continued)

*Primary Examiner*—Louis Huynh
(74) *Attorney, Agent, or Firm*—Birch, Stewart, Kolasch and Birch, LLP

(57) ABSTRACT

A method and machine for packing a group of cartons of cigarettes in a flat tubular package, whereby a first portion and a second portion of a suction gripping head respectively engage a first lateral wall of the flat tubular package, and a second lateral wall of the flat tubular package separated from the first lateral wall by a respective preformed fold line; a rotational movement is then generated between the first and second portion of the suction gripping head to rotate the first and second lateral wall engaged by the suction gripping head with respect to each other, and so convert the flat tubular package from the flat configuration to an open configuration; the group of cartons of cigarettes is then pushed inside the open tubular package, and the suction gripping head is moved to feed the open tubular package to a sealing station where the open tubular package is sealed.

30 Claims, 2 Drawing Sheets

U.S. PATENT DOCUMENTS

| | | | | |
|---|---|---|---|---|
| 5,536,231 | A * | 7/1996 | Nilsson | 493/315 |
| 5,613,828 | A | 3/1997 | Haddow et al. | |
| 5,928,123 | A * | 7/1999 | Davis, Jr. | 493/317 |
| 6,913,568 | B2 * | 7/2005 | Frank et al. | 493/313 |
| 6,915,622 | B2 * | 7/2005 | Spatafora | 493/313 |

FOREIGN PATENT DOCUMENTS

| | | | |
|---|---|---|---|
| EP | 1 020 361 | A2 | 7/2000 |
| GB | 1 340 581 | A | 12/1973 |
| WO | WO-89/00132 | A1 | 1/1989 |

* cited by examiner

METHOD AND MACHINE FOR PACKING A PRODUCT IN A FLAT TUBULAR PACKAGE

TECHNICAL FIELD

The present invention relates to a method and to a machine for packing a product in a flat tubular package.

The present invention may be used to advantage on a cigarette carton boxing machine, i.e. a machine for packing groups of cartons of cigarettes in respective boxes, to which the following description refers purely by way of example.

BACKGROUND ART

Machines for boxing cartons of cigarettes currently comprise a unit for supplying and opening flat tubular packages, and which receives a stack of flat tubular packages on a pallet, and feeds each flat tubular package to a respective seat on a conveyor, which feeds the tubular package along a straight packing path. Along the packing path, each tubular package remains connected to the respective seat, and is fed through an opening station, where the tubular package is opened into a configuration suitable for receiving a respective group of cartons of cigarettes; through an insertion station, where a respective group of cartons of cigarettes is pushed inside the open tubular package; and, finally, through a sealing station, where the tubular package is sealed by gumming and folding the relative flaps.

Known boxing machines of the above type are fairly bulky, and, for use on the machine, require accurate positioning of the stack of flat tubular packages, and therefore periodic assistance on the part of the operator.

WO8900132 discloses a carton loading and closing machine comprising a carton opening mechanism adapted to remove a flat carton from a magazine to a park position, means for folding the side flaps at the bottom of the carton outwardly, means for loading product into carton through its open bottom, means for indexing the loaded carton forwardly over cam means for folding the leading end flap under the product, trailing end flap closing means having a slot adapted to receive the trailing end flap and means for causing said trailing end flap to be folded to the closed position as said folding means is moved transversely with respect to the stationary carton, and means for closing the side flaps and the top flaps of the carton.

DISCLOSURE OF INVENTION

It is an object of the present invention to provide a method and a machine for packing a product in a flat tubular package, designed to eliminate the aforementioned drawbacks, and which, in particular, is straightforward and cheap to implement.

According to the present invention, there is provided a method of packing a product in a flat tubular package as recited by Claim 1.

According to the present invention, there is provided a machine for packing a product in a flat tubular package as recited by Claim 15.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
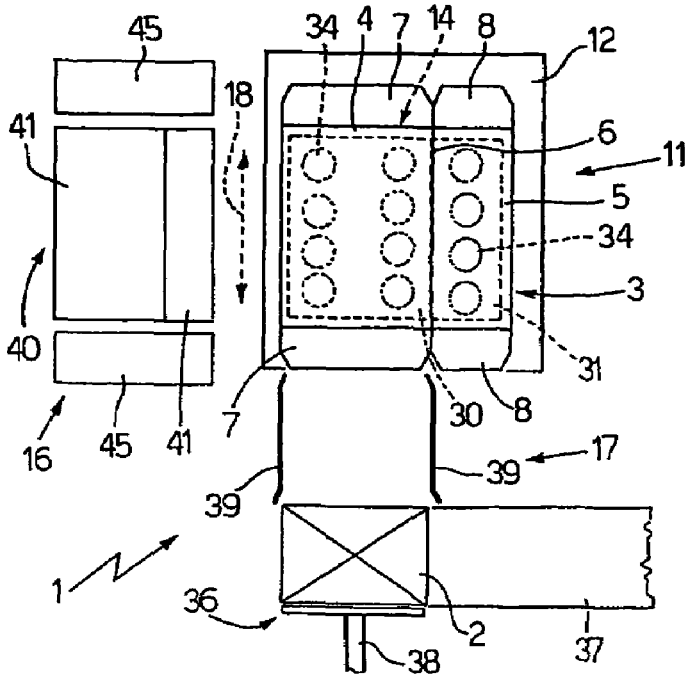
FIG. 1 shows a schematic plan view, with parts removed for clarity, of a cigarette carton boxing machine in accordance with the present invention.

Number 1 in FIG. 1 indicates as a whole a boxing machine for boxing groups 2 of cartons of cigarettes, and which inserts each group 2 of cartons of cigarettes inside a respective tubular package 3 having two major lateral walls 4; and two minor lateral walls 5, each connected on one side to one major lateral wall 4, and on the other side to the other major lateral wall 4, by respective preformed fold lines 6. More specifically, each major lateral wall 4 has two flaps 7, and each minor lateral wall 5 has two flaps 8; and, once group 2 of cartons of cigarettes is inserted inside a respective tubular package 3, the relative flaps 7 and 8 are folded one on top of another to define two end walls 9. Once flaps 7 and 8 are folded, the shape of tubular package 3 is preferably stabilized by applying respective lengths of adhesive tape 10 to both end walls 9.

Boxing machine 1 comprises a pickup station 11, which houses a pallet 12 supporting a stack 13 of flat tubular packages 3, i.e. tubular packages 3 pressed into a flat configuration and lying in a horizontal plane.

Boxing machine 1 also comprises a suction gripping head 14 for engaging the free major lateral wall 4 and the free minor lateral wall 5 of the top flat tubular package 3 in stack 13; and an actuating device 15 supporting gripping head 14, and for moving gripping head 14 from pickup station 11 to a sealing station 16 via an intermediate feed station 17.

Figure 2:
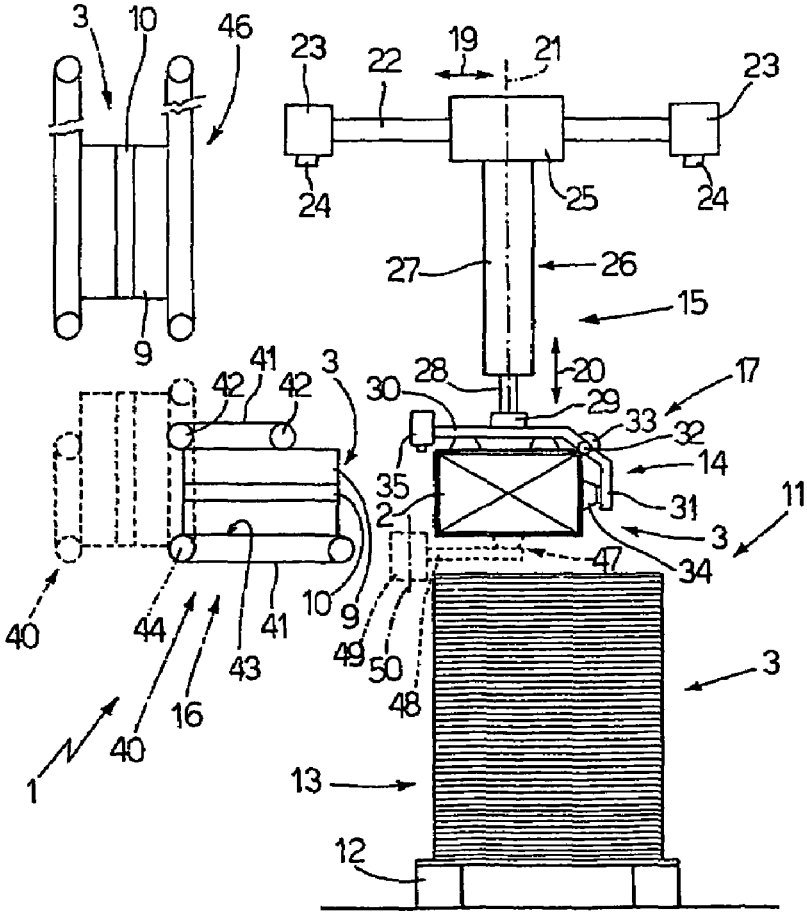
FIG. 2 shows a front view, with parts removed for clarity, of the FIG. 1 boxing machine.

As shown in FIG. 2, actuating device 15 moves gripping head 14 with four degrees of freedom comprising three translatory movements in three perpendicular directions 18, 19, 20 (18 shown in FIG. 1); and a rotational movement about a vertical axis 21 perpendicular to the horizontal plane of flat tubular packages 3 in stack 13. More specifically, actuating device 15 comprises a guide 22 supported at the ends by two powered carriages 23, which run along respective guides 24 to move guide 22 in horizontal direction 18 perpendicular to the FIG. 2 plane. A powered carriage 25 runs along guide 22, and supports a linear actuator 26 moved by carriage 25 in horizontal direction 19. Linear actuator 26 comprises a member 27 integral with carriage 25; and a member 28 supporting gripping head 14 and moved with respect to member 27 in vertical direction 20; and a powered articulated joint 29 is interposed between member 28 and gripping head 14 to rotate gripping head 14 about vertical axis 21.

Actuating device 15 therefore maintains suction gripping head 14 horizontal at all times, and therefore parallel to the plane of flat tubular packages 3.

Suction gripping head 14 comprises a suction portion 30 for engaging a major lateral wall 4 of a tubular package 3, and a suction portion 31, which engages a minor lateral wall 5 of a tubular package 3, is hinged to suction portion 30, and is rotated, with respect to suction portion 30, about a horizontal axis 32 by an actuating device 33 carried by suction gripping head 14. More specifically, suction portions 30 and 31 of gripping head 14 have respective known suction cups 34 made of deformable elastic material and connectable internally to a known suction source (not shown).

Figure 3:
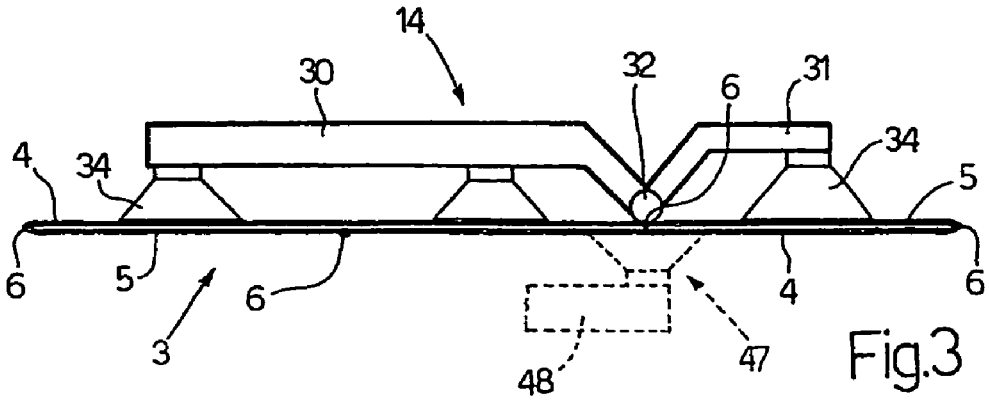
FIGS. 3, 4 and 5 show, schematically, an operating sequence of a gripping head of the FIG. 1 boxing machine.
Figure 4:
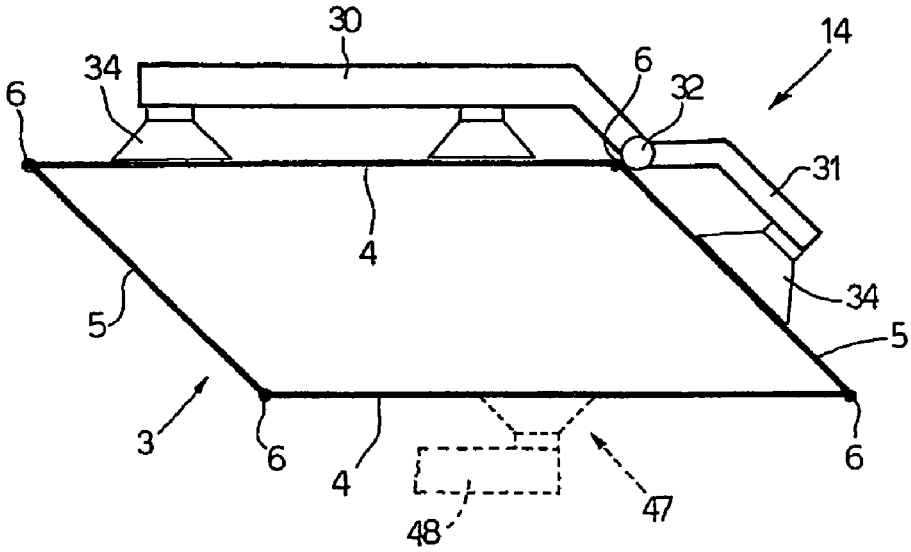
Figure 5:
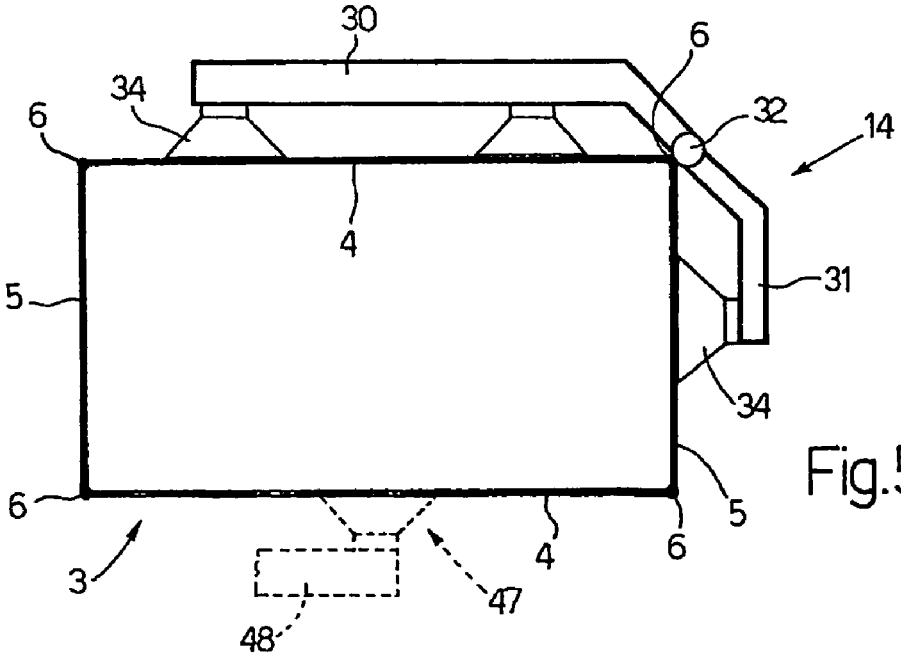

As shown in FIGS. 3, 4 and 5, the axis of rotation 32 between portions 30 and 31 coincides substantially (i.e. exactly or very nearly) with the fold line 6 between lateral walls 4 and 5 engaged by gripping head 14. In a further embodiment not shown, the axis of rotation 32 between portions 30 and 31 does not coincide with the fold line 6 between lateral walls 4 and 5 engaged by gripping head 14, and suction cups 34 of portion 30 are fitted to portion 30 so as to slide in a direction perpendicular to axis of rotation 32.

As shown in FIG. 2, suction gripping head 14 comprises a known optical sensor 35 for determining the exact position of the top flat tubular package 3 in stack 13 before the flat tubular package 3 is engaged; and a known control unit (not shown) is provided to control actuating device 15 supporting suction gripping head 14, so as to adapt the position of suction gripping head 14 to the exact position reading of flat tubular package 3, and engage the flat tubular package 3 in accordance with a given mutual arrangement. Actuating device 15 thus provides for correcting any errors in the position of flat tubular packages 3 in stack 13.

As shown in FIGS. 1 and 2, pickup station 11 is located beneath feed station 17, where an insertion device 36 inserts a group 2 of cartons of cigarettes inside a respective open tubular package 3 supported by suction gripping head 14. Insertion device 36 comprises a belt conveyor 37 for feeding groups 2 of cartons of cigarettes successively into alignment with the open tubular package 3 at feed station 17; and a pusher 38 for pushing group 2 of cartons of cigarettes inside the open tubular package 3. Fixed sections 39 are preferably provided between conveyor 37 and tubular package 3 to assist insertion of group 2 of cartons of cigarettes inside respective open tubular package 3, and in particular to keep flaps 7 and 8 of tubular package 3 clear of the path of group 2 of cartons of cigarettes.

Sealing station 16 is located alongside and on a level with feed station 17, and comprises a belt conveyor 40, in turn comprising two suction belts 41 looped about respective powered end pulleys 42 to define a channel 43 for receiving and conveying an open tubular package 3 containing a respective group 2 of cartons of cigarettes. Conveyor 40 is hinged to rotate, under control of a known motor (not shown) and about a horizontal axis 44, between a horizontal position (shown by the continuous line in FIG. 2) wherein conveyor 40 feeds a tubular package 3 along a horizontal path inside channel 43, and a vertical position (shown by the dash line in FIG. 2) wherein conveyor 40 feeds a tubular package 3 along a vertical path inside channel 43.

In the horizontal position, conveyor 40 is connected to two known sealing devices 45 located on opposite sides of conveyor 40, and which fold down, one on top of another, the flaps 7 and 8 of a tubular package 3 travelling inside channel 43, and apply respective lengths of adhesive tape 10 to the folded flaps 7 and 8 to define end walls 9 of tubular package 3.

In the vertical position, conveyor 40 is aligned with a follow-up belt conveyor 46, which receives the sealed tubular packages 3 from conveyor 40, and feeds tubular packages 3 to a known output station (not shown) of boxing machine 1.

In an alternative embodiment not shown, conveyor 40 is fixed, and conveyor 46 is aligned horizontally with conveyor 40. In a further embodiment not shown, sealing devices 45 are located at feed station 17 to seal the tubular package 3 at feed station 17, as soon as a respective group 2 of cartons of cigarettes is inserted by insertion device 36 inside the open tubular package 3.

Operation of boxing machine 1 will now be described with reference to the top flat tubular package 3 in stack 13, and to a respective group 2 of cartons of cigarettes.

To begin with, actuating device 15 moves suction gripping head 14 over to pickup station 11 to engage the flat tubular package 3, and so that suction portion 30 of suction gripping head 14 engages major lateral wall 4 of flat tubular package 3, and suction portion 31 of suction gripping head 14 engages minor lateral wall 5 of flat tubular package 3. More specifically, actuating devices 15 moves suction gripping head 14 over to roughly the estimated position of flat tubular package 3 (i.e. the position occupied in normal conditions); by means of optical sensor 35, suction gripping head 14 then determines the real position of flat tubular package 3; and, on the basis of the real-position reading of flat tubular package 3, actuating device 15 is operated to adapt the position of suction gripping head 14 to the real position of flat tubular package 3, and so enable gripping head 14 to engage flat tubular package 3 in accordance with a given mutual arrangement.

Actuating device 15 then moves suction gripping head 14, together with flat tubular package 3, from pickup station 11 to feed station 17. And, as it is being transferred from pickup station 11 to feed station 17, tubular package 3 is converted from the flat configuration to an open configuration by rotating portion 31 of suction gripping head 14 ninety degrees about axis 32 with respect to portion 30 of suction gripping head 14.

The relative rotation between portions 30 and 31 of suction gripping head 14 is shown in FIGS. 3, 4 and 5, which clearly show how 90° rotation about axis 32 of portion 31 with respect to portion 30 produces a like rotation, about respective fold line 6, of minor lateral wall 5, engaged by portion 31, with respect to major lateral wall 4 engaged by portion 30; which 90° rotation between lateral walls 4 and 5 engaged by gripping head 14 causes tubular package 3 to pass from the flat to the open configuration. Since the axis of rotation 32 between portions 30 and 31 substantially coincides with fold line 6 between lateral walls 4 and 5 engaged by gripping head 14, all the points on portion 31 perform the same movement as the corresponding points on minor lateral wall 5, and no translatory movement is generated between suction cups 34 of portion 31 and minor lateral wall 5. Conversely, if the axis of rotation 32 between portions 30 and 31 does not coincide with fold line 6 between lateral walls 4 and 5 engaged by gripping head 14, the points on portion 31 perform a different movement with respect to the corresponding points on minor lateral wall 5, thus resulting in translatory movement between suction cups 34 of portion 31 and minor lateral wall 5, which must be compensated by a like translatory movement of suction cups 34 with respect to portion 31 in a direction perpendicular to axis 32 to avoid generating potentially harmful stress on minor lateral wall 5.

Actuating device 15 moves suction gripping head 14, engaging tubular package 3, into feed station 17, so as to align the open tubular package 3 with insertion device 36. Since feed station 17 is located over pickup station 11, the above transfer is made by a main movement in vertical direction 20, by small adjusting movements in the other horizontal directions 18 and 19, and by small rotations about axis 21.

Once tubular package 3 is aligned with insertion device 36, pusher 38 of insertion device 36 is moved to insert group 2 of cartons of cigarettes inside the open tubular package 3. Actuating device 15 then moves suction gripping head 14, engaging the open tubular package 3 containing group 2 of cartons of cigarettes, to feed tubular package 3 to sealing station 16, by inserting the open tubular package 3 inside channel 43 of conveyor 40. Once the open tubular package 3 containing group 2 of cartons of cigarettes is engaged on opposite sides by suction belts 41 of conveyor 40, suction head 14 releases tubular package 3 by cutting off suction through suction cups 34, and actuating device 15 is returned to pickup station 11. To assist transfer of the open tubular package 3 from gripping head 14 to conveyor 40, the bottom belt 41 of conveyor 40 is longer than the top belt 41 of conveyor 40.

Conveyor 40 then feeds the open tubular package 3 inside channel 43, so that the open tubular package 3 cooperates with sealing devices 45, which fold flaps 7 and 8 of tubular package 3 down one on top of another, and apply respective lengths of adhesive tape 10 to the folded flaps 7 and 8. For which purpose, the open tubular package 3 is inserted inside channel 43 by gripping head 14, so that respective flaps 7 and 8 project laterally from channel 43.

Finally, the sealed tubular package 3 is transferred from conveyor 40 to conveyor 46, and from this to the output station (not shown) and off boxing machine 1.

In an alternative embodiment shown by the dash line in FIGS. 2-5, a further suction gripping head 47 is fitted to an arm 48 rotated horizontally by an actuating device 49 about a vertical axis 50.

In actual use, when suction gripping head 14 is moved over to pickup station 11 to engage the top flat tubular package 3 in stack 13, arm 48 is maintained by actuating device 49 in a rest position (not shown) to enable free vertical movement of suction gripping head 14, i.e. in direction 20.

Once suction gripping head 14, together with flat tubular package 3, is moved by actuating device 15 from pickup station 11 to feed station 17, actuating device 49 rotates arm 48 about axis 50 to move suction gripping head 47 into a work position (FIGS. 2-5) engaging the bottom major lateral wall 4, i.e. the one opposite the major lateral wall 4 engaged by suction gripping head 14. As of this position, tubular package 3 is converted from the flat to the open configuration by rotating portion 31 of suction gripping head 14 ninety degrees about axis 32 with respect to portion 30 of suction gripping head 14, and also by means of a relative rotation movement between suction gripping head 14 and suction gripping head 47, which is effected by keeping suction gripping head 47 stationary, and moving suction gripping head 14 by means of actuating device 15.

Once tubular package 3 is in the open configuration, suction gripping head 47 releases the bottom major lateral wall 4 of tubular package 3, and is restored by actuating device 49 to the rest position (not shown).

Using a further suction gripping head 47 as described above ensures correct opening, and safeguards against damage to, tubular packages 3 in any situation.

Boxing machine 1 as described above has countless advantages, by being relatively straightforward and compact, and by operating with stacks 13 of flat tubular packages 3 which need not necessarily be positioned accurately, and which can therefore be fed fully automatically.

The invention claimed is:

1. A method of packing a product in a flat tubular package having two first lateral walls; and two second lateral walls, each connected on one side to one first lateral wall, and on the other side to the other first lateral wall, by respective preformed fold lines; the method comprising the steps of engaging a first lateral wall of the flat tubular package and a second lateral wall of the flat tubular package by means of a first portion and a second portion respectively of a first suction gripping head, generating a rotational movement between the first and second portion of the first suction gripping head, to rotate the first and second lateral wall engaged by the first suction gripping head with respect to each other, and so convert the flat tubular package from the flat configuration to an open configuration, and inserting the product inside the open tubular package;

wherein the first and second portion of the first suction gripping head are hinged and rotated about an axis of rotation not coincident with the fold line between the first and second lateral wall engaged by the first suction gripping head;

wherein the first and second portion of the first suction gripping head comprise respective suction cups; and wherein the suction cups of the second portion are fitted to the second portion to move in a direction perpendicular to the axis of rotation during the rotational movement between the first and second portion of the first suction gripping head.

2. A method as claimed in claim 1, wherein the flat tubular package is engaged by the first suction gripping head at a pickup station, and is transferred, attached to the first suction gripping head, to a receiving station where the product is inserted inside the open tubular package; the fiat tubular package being converted from the flat configuration to the open configuration during transfer from the pickup station to the receiving station.

3. A method as claimed in claim 2, wherein, following insertion of the product inside the open tubular package, the first suction gripping head engaging the open tubular package is moved to feed the open tubular package to a sealing station where the open tubular package containing the product is sealed.

4. A method as claimed in claim 3, wherein the first suction gripping head transfers the open tubular package to conveying means located at the sealing station and for feeding the open tubular package through the sealing station and for feeding the sealed tubular package to an output station.

5. A method as claimed in claim 3, wherein the open tubular package is sealed by folding, one on top of another, flaps projecting from a first and a second lateral walls of the tubular package, and by applying respective lengths of adhesive tape to the folded flaps.

6. A method as claimed in claim 2, wherein, following insertion of the product inside the open tubular package, the open tubular package is sealed at the receiving station, and the first suction gripping head engaging the scaled tubular package is moved to feed the sealed tubular package to an output station.

7. A method as claimed in claim 1, wherein the flat tubular package is picked rip by the first suction gripping head off a stack of flat tubular packages.

8. A method as claimed in claim 7 and comprising the further steps of determining, before engaging the top flat tubular package in the stack, the exact position of the flat tubular package using a sensor, and adapting the position of the first suction gripping head according to the exact position of the flat tubular package so as to engage the flat tubular package in accordance with a given mutual arrangement.

9. A method as claimed in claim 8, wherein the first suction gripping head is movable with four degrees of freedom comprising three translatory movements in three perpendicular directions, and one rotational movement about an axis perpendicular to the plane of the flat tubular package.

10. A method as claimed in claim 1, and comprising the step of engaging, by means of a second suction gripping head, the first lateral wall of the flat tubular package opposite the flu st lateral wall engaged by the first suction gripping head; the fiat tubular package being converted from the flat configuration to the open configuration by the rotational movement between the first and second portion of the first suction gripping head, and also by a relative rotational movement between the first suction gripping head and the second suction gripping head.

11. A method as claimed in claim 10, wherein, once the flat tubular package is converted to the open configuration, the second suction gripping head releases the first lateral wall of the open tubular package.

12. A method as claimed in claim 10, wherein the second suction gripping head is rotated about a vertical axis between a rest position allowing free vertical movement of the first suction gripping head, and a work position wherein the second suction gripping head engages the flat tubular package.

13. A method as claimed in claim 10, wherein the relative rotational movement between the first suction gripping head and the second suction gripping head is made by keeping the second suction gripping head stationary, and moving the first suction gripping head.

14. A method as claimed in claim 1, wherein the product is defined by a group of cartons of cigarettes.

15. A machine for packing a product in a flat tubular package having two first lateral walls; and two second lateral walls, each connected on one side to one first lateral wall, and on the other side to the other first lateral wall, by respective preformed fold lines; the machine comprising a first suction gripping head having a first and a second portion, a first actuating device for causing the first portion and the second portion of the first suction gripping head to engage a first lateral wall of the flat tubular package and a second lateral wall of the fiat tubular package respectively, actuating means for generating a rotational movement between the first and second portion of the first suction gripping head, to rotate the first and second lateral wall engaged by the first suction gripping head with respect to each other, and so convert the flat tubular package from the flat configuration to an open configuration, and an insertion device for inserting the product inside the open tubular package;

wherein the first and second portion of the first suction gripping head are hinged and rotated by the actuating means about an axis of rotation not coincident with the fold line between the first and second lateral wall engaged by the first suction gripping head;

wherein the first and second portion of the first suction gripping head comprise respective suction cups; and wherein the suction cups of the second portion being are fitted to the second portion to move in a direction perpendicular to the axis of rotation during the rotational movement between the first and second portion of the first suction gripping head.

16. A machine as claimed in claim 15, and comprising a pickup station, where the flat tubular package is engaged by the first suction gripping head, and a receiving station; the first actuating device moving the first suction gripping head attached to the fiat tubular package, from the pickup station to the receiving station; and the actuating means generating a rotational movement between the first and second portion of the first suction gripping head as the first suction gripping head is moved from the pickup station to the receiving station.

17. A machine as claimed in claim 16, wherein the pickup station houses at least one stack of flat tubular packages, which are engaged successively by the first suction gripping head.

18. A machine as claimed in claim 17, wherein the first suction gripping head comprises a sensor for determining the exact position of the top flat tubular package in the stack before the flat tubular package is engaged; a control unit being provided to control the first actuating device supporting the first suction gripping head so as to adapt the position of the first suction gripping head to the exact position of the flat tubular package, and engage the flat tubular package in accordance with a given mutual arrangement.

19. A machine as claimed in claim 18, wherein the first actuating device moves the first suction gripping head with four degrees of freedom comprising three translatory movements in three perpendicular directions, and one rotational movement about an axis perpendicular to the plane of the flat tubular package.

20. A machine as claimed claim 16, and comprising an output station; and conveying means for receiving the open tubular package containing the product from the first suction gripping head, and for feeding the open tubular package containing the product to the output station.

21. A machine as claimed in claim 20, and comprising sealing means for sealing the open tubular package containing the product.

22. A machine as claimed in claim 21, wherein the sealing means are connected to the conveying means.

23. A machine as claimed in claim 22, wherein the sealing means are located at the receiving station.

24. A machine as claimed in claim 20, wherein said conveying means comprise a first belt conveyor hinged to rotate about a horizontal axis between a horizontal position, in which the first conveyor feeds the open tubular package containing the product along a horizontal path, and a vertical position, in which the first conveyor feeds the open tubular package along a vertical path.

25. A machine as claimed in claim 24, wherein said conveying means comprise a second belt conveyor aligned with the first belt conveyor when the first belt conveyor is in said vertical position.

26. A machine as claimed in claim 15, wherein the insertion device comprises a conveyor for feeding the product into alignment with the open tubular package; and a pusher for pushing the product inside the open tubular package.

27. A machine as claimed in claim 26, wherein the insertion device comprises fixed sections for assisting insertion of the product inside the open tubular package.

28. A machine as claimed in claim 15, and comprising a second suction gripping head, and a second actuating device for causing the second suction gripping head to engage the first lateral wall of the flat tubular package opposite the first lateral wall engaged by the first suction gripping head; the flat tubular package being converted from the flat configuration to the open configuration by the rotational movement between the first and second portion of the first suction gripping head, and also by a relative rotational movement between the first suction gripping head and the second suction gripping head.

29. A machine as claimed in claim 28, wherein the second actuating device rotates the second suction gripping head about a vertical axis between a rest position permitting free vertical movement of the first suction gripping head, and a work position, in which the second suction gripping head engages the fiat tubular package.

30. A machine as claimed in claim 28, wherein the relative rotational movement between the first suction gripping head and the second suction gripping head is generated solely by the first actuating device.

* * * * *